US008454460B2

(12) United States Patent
Connerley

(10) Patent No.: US 8,454,460 B2
(45) Date of Patent: Jun. 4, 2013

(54) BREAKAWAY BASKETBALL RIM ASSEMBLY

(75) Inventor: James J. Connerley, Noblesville, IN (US)

(73) Assignee: Gared Holdings, LLC, Noblesville, IN (US)

( * ) Notice: Subject to any disclaimer, the term of this patent is extended or adjusted under 35 U.S.C. 154(b) by 168 days.

(21) Appl. No.: 13/070,126

(22) Filed: Mar. 23, 2011

(65) Prior Publication Data

US 2012/0244965 A1 Sep. 27, 2012

(51) Int. Cl.
*A63B 63/08* (2006.01)

(52) U.S. Cl.
USPC ..... 473/486

(58) Field of Classification Search
USPC ..... 473/479, 480, 481, 482, 483, 484, 473/485, 486, 487
See application file for complete search history.

(56) References Cited

U.S. PATENT DOCUMENTS

| | | | | |
|---|---|---|---|---|
| 3,188,913 | A | 6/1965 | O'Shei et al. | 88/98 |
| 3,233,898 | A | 2/1966 | Sheets et al. | 273/1.5 |
| 4,111,420 | A | 9/1978 | Tyner | 273/1.5 R |
| 4,194,734 | A | 3/1980 | Tyner | 273/1.5 R |
| 4,365,802 | A | 12/1982 | Ehrat | 273/1.5 R |
| 4,433,839 | A | 2/1984 | Simonseth | 273/1.5 R |
| 4,441,709 | A | 4/1984 | Schroeder et al. | 273/1.5 R |
| 4,534,556 | A | 8/1985 | Estlund et al. | 273/1.5 R |
| 4,723,777 | A | 2/1988 | Jolly | 273/1.5 R |
| 5,106,084 | A * | 4/1992 | Vaught | 473/486 |
| 5,348,289 | A * | 9/1994 | Vaught | 473/486 |
| 5,480,139 | A * | 1/1996 | Owen et al. | 473/486 |
| 5,586,759 | A | 12/1996 | Fitzsimmons et al. | 273/1.5 R |
| 5,628,506 | A | 5/1997 | Vaught | 473/486 |
| 5,685,790 | A | 11/1997 | Vaught | 473/486 |
| 5,716,294 | A | 2/1998 | Childers et al. | 473/486 |
| 5,830,090 | A | 11/1998 | Fitzsimmons et al. | 473/486 |
| 6,080,071 | A * | 6/2000 | Childers et al. | 473/486 |
| 6,186,911 | B1 | 2/2001 | Manthey | 473/486 |
| 6,296,583 | B1 | 10/2001 | Tatar, Sr. | 473/486 |
| 6,447,409 | B1 | 9/2002 | Squibb | 473/486 |
| 6,503,160 | B2 | 1/2003 | Hehr | 473/486 |
| 6,935,972 | B2 | 8/2005 | Hehr | 473/486 |

(Continued)

FOREIGN PATENT DOCUMENTS

| | | | |
|---|---|---|---|
| EP | 2 281 611 A1 | | 2/2011 |
| EP | 2502650 | * | 9/2012 |
| GB | 854885 | | 11/1960 |
| GB | 900208 | | 7/1962 |

*Primary Examiner* — Gene Kim
*Assistant Examiner* — M Chambers
(74) *Attorney, Agent, or Firm* — Brinks Hofer Gilson & Lione

(57) ABSTRACT

A basketball rim mounting assembly permitting multi-directional deflection in response to extraordinary forces imposed on the rim has a fixed portion coupled to a backboard and a movable portion fixed to a basketball rim. The fixed portion can include a back plate secured to a front face of the backboard and a pair of bracket plates fixed to extend forward from the back plate. A tilt regulating structure can control the extent of deflection of the rim relative to the backboard such that the extraordinary force necessary to cause the rim to break-away from its normal position is the same in any direction. The tilt regulating structure can bias a rollable member within a detent formed in the back plate. A pivot axis member can be coupled to the tilt regulating structure to define the tilt and roll axes of the movable portion relative to the fixed portion.

20 Claims, 8 Drawing Sheets

U.S. PATENT DOCUMENTS

| | | | | |
|---|---|---|---|---|
| 7,175,551 | B1 | 2/2007 | Hamilton | 473/486 |
| 7,214,148 | B2 * | 5/2007 | Mahoney | 473/486 |
| 7,628,718 | B2 * | 12/2009 | Connerley | 473/485 |
| 7,798,921 | B2 * | 9/2010 | Connerley | 473/485 |
| 2003/0054906 | A1 * | 3/2003 | Allshouse et al. | 473/486 |
| 2006/0148598 | A1 * | 7/2006 | Mahoney | 473/481 |
| 2007/0015614 | A1 * | 1/2007 | Connerley | 473/481 |
| 2007/0167265 | A1 * | 7/2007 | Connerley | 473/485 |
| 2010/0035707 | A1 * | 2/2010 | Connerley | 473/486 |
| 2012/0244965 | A1 * | 9/2012 | Connerley | 473/486 |

* cited by examiner

BREAKAWAY BASKETBALL RIM ASSEMBLY

TECHNICAL FIELD

The present disclosure relates to basketball goals, consisting generally of a basket, rim, and support, which are capable of deflecting in a variety of directions upon application of sufficient force, such as from a dunk shot, to prevent damage to the rim and associated backboard to which the goal is mounted. In particular, it relates to such a goal that can automatically return to an original position upon removal of the force.

BACKGROUND

Breakaway basketball rim assemblies typically include a spring energy basketball goal/backboard unit incorporated into a conventional vertically aligned backboard and horizontally aligned goal, i.e., the basket. The goal can be spring mounted to pivot relative to the backboard forwardly and downwardly out of its normal horizontal plane when a predetermined excess force is applied such as when a player dunks the basketball and slaps, hits or pulls the goal with his hands, wrists, or arms. The goal may then return to its original position with the spring energy of the return motion being dissipated by the spring portion. Provision can also be made for the goal to deflect sideward. The spring portion providing the return forces may be mounted in front of the backboard and connected to the goal by members extending though openings in the backboard.

U.S. Pat. Nos. 5,716,294 and 6,080,071 disclose a breakaway basketball rim assembly in which there is a release assembly which operably interconnects the base member and the rim member. The release assembly is configured to release the rim member in response to a downward load that is received at any point along an extended frontal arc of the circular hoop, so that the hoop tilts downwardly generally in the direction of the load. There is also a reaction load mechanism for returning the hoop to its horizontal playing position. A U-shaped fulcrum joint extends between the reaction load in the hoop so as to provide a pivot point in line between the reaction load and any impact point along the extended frontal arc of the hoop. The joint is configured so that the rim releases in response to a substantially identical impact load anywhere along the frontal arc.

U.S. Pat. No. 6,447,409 discloses another breakaway basketball rim assembly with a mounting unit with a vertical base plate and a horizontal mounting plate, and a rim unit having a circular hoop portion and a pivot plate that projects rearwardly from the hoop portion in spaced relation above the mounting plate. A ball bearing is positioned between the pivot plate and the mounting plate to provide the pivot point for releasing the rim unit when a downward load is placed upon the hoop portion. At least one stop is placed on top of the mounting plate to restrict the movement of the pivot plate and load a plurality of spring-loaded attachments that extend from the pivot plate through the mounting plate to return the rim unit to a generally horizontal position.

Despite the various features and benefits of the structures of the forgoing disclosures, there remains a need for an inexpensive, compact basketball rim support that permits controlled deflection of the rim in a variety of directions, while maintaining the rim at the conventional position during any normal impact between a basketball and the rim, and includes an automatic return mechanism for returning the rim to its original position without have to resort to any manual reset of that position.

SUMMARY

These several needs are satisfied by a basketball rim mounting assembly that is designed to allow multi-directional deflection in response to extraordinary forces imposed on the rim. The basketball rim mounting assembly can include a fixed portion and a movable portion. The fixed portion can be adapted to be coupled to a backboard, and the movable portion can be fixed to a basketball rim. The fixed portion may include a back plate adapted to be secured to the backboard. The back plate may have an opening detent formed therein. A pair of vertical bracket plates may be fixed to and extended forward from the back plate. The movable portion may include a top plate extending at least between the bracket plates, and a tilt regulating structure coupled between the fixed portion and the movable portion. The tilt regulating structure can include a retaining member, a first wall with a window formed therein, and a rollable member positioned at least partially within the widow. The first wall may be interposed between the retaining member and the back plate. The retaining member can bias the rollable member in a rest position within the opening detent when the basketball rim is in a horizontal position. Deflection of the basketball rim to a non-horizontal position can cause displacement of the rollable member away from the rest position to a displaced position by the window.

In another example, the basketball rim mounting assembly can include a pivot axis member coupled between the fixed portion and the movable portion. The pivot axis member can define a tilt axis of pivot and a roll axis of pivot for the movable portion. A tilt regulating structure can be coupled to the pivot axis member, and can include a retaining member and a rollable member positioned between the retaining member and the back plate. The retaining member can bias the rollable member against the back plate in a rest position when the basketball rim is in a horizontal position. Deflection of the basketball rim to a non-horizontal position can cause the pivot axis member to pivot about at least one of the longitudinal axis and the lateral axis and displacement of the rollable member away from the rest position along the back plate.

In another example, the basketball rim mounting assembly can include a pivot axis member that includes a first pivot block, which defines a cavity and includes a guiding window. A tilt regulating structure can include a retaining member, a cylindrical roller positioned at least partially within the guiding widow, and a biasing member. The retaining member can be situated within the cavity of the first pivot block, with the biasing member coupled between the retaining member and the first pivot block. The retaining member can bias the roller through the guiding window in a first position within the opening detent when the basketball rim is in a horizontal position. Deflection of the basketball rim to a non-horizontal position can cause displacement of the roller by one or more sides of the guiding window away from the first position.

Other features of the present invention and the corresponding advantages of those features will become apparent from the following discussion of the preferred embodiments of the present invention, exemplifying the best mode of practicing the present invention, which is illustrated in the accompanying drawings. The components in the figures are not necessarily to scale, emphasis instead being placed upon illustrating the principles of the invention. Moreover, in the figures, like referenced numerals designate corresponding parts throughout the different views.

DETAILED DESCRIPTION OF EMBODIMENTS WITH THE DRAWINGS

Figure 1:
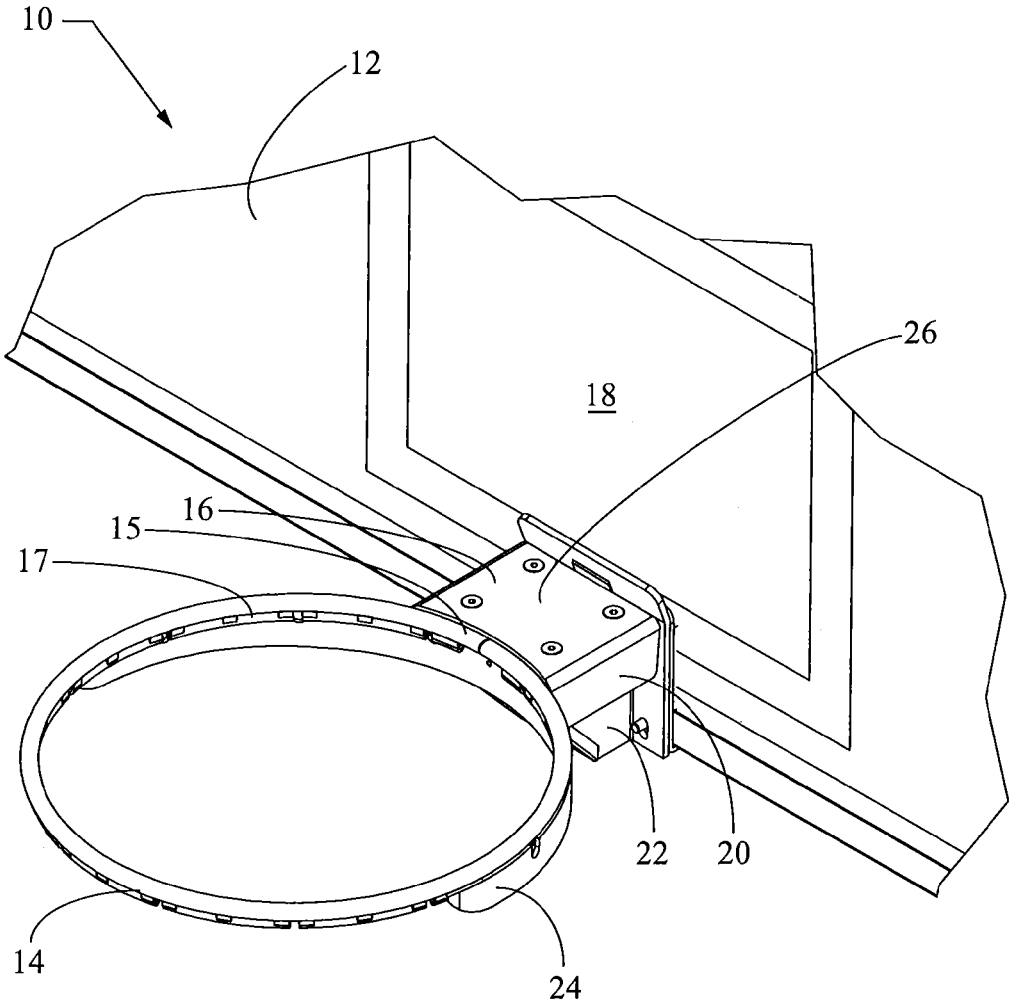
FIG. 1 is a perspective view of a basketball rim mounting assembly mounted to a backboard.

Where like reference numerals are used throughout the figures to designate like component, the figures depict a basketball goal 10. In FIG. 1, the basketball goal 10 can be mounted to a vertical backboard 12 so that a rim 14 of the goal 10 is in the conventional horizontal position. A net, not shown, can be suspended from the rim 14 in the usual manner. The rim 14 can be fixed to a top plate 16, which may extend from a back segment 15 of the rim to the front surface 18 of the backboard 12. Side plates 20 can be fixed to the top plate 16 to extend downward over, and outside of, bracket plates 22, which can be fixed to the backboard 12. An arcuate reinforcement 24 can be provided over a further back segment 17 of the rim 14 to ensure that the rim has the desired stability with respect to the top plate 16 and side plates 20. The rim 14, top plate 16, side plates 20 and reinforcement 24 can be joined together to form a unitized structure that can move as a movable portion 26 in relation to the backboard 12, bracket plates 22, and other structure, described below, that is fixed to the backboard 12.

Figure 2:
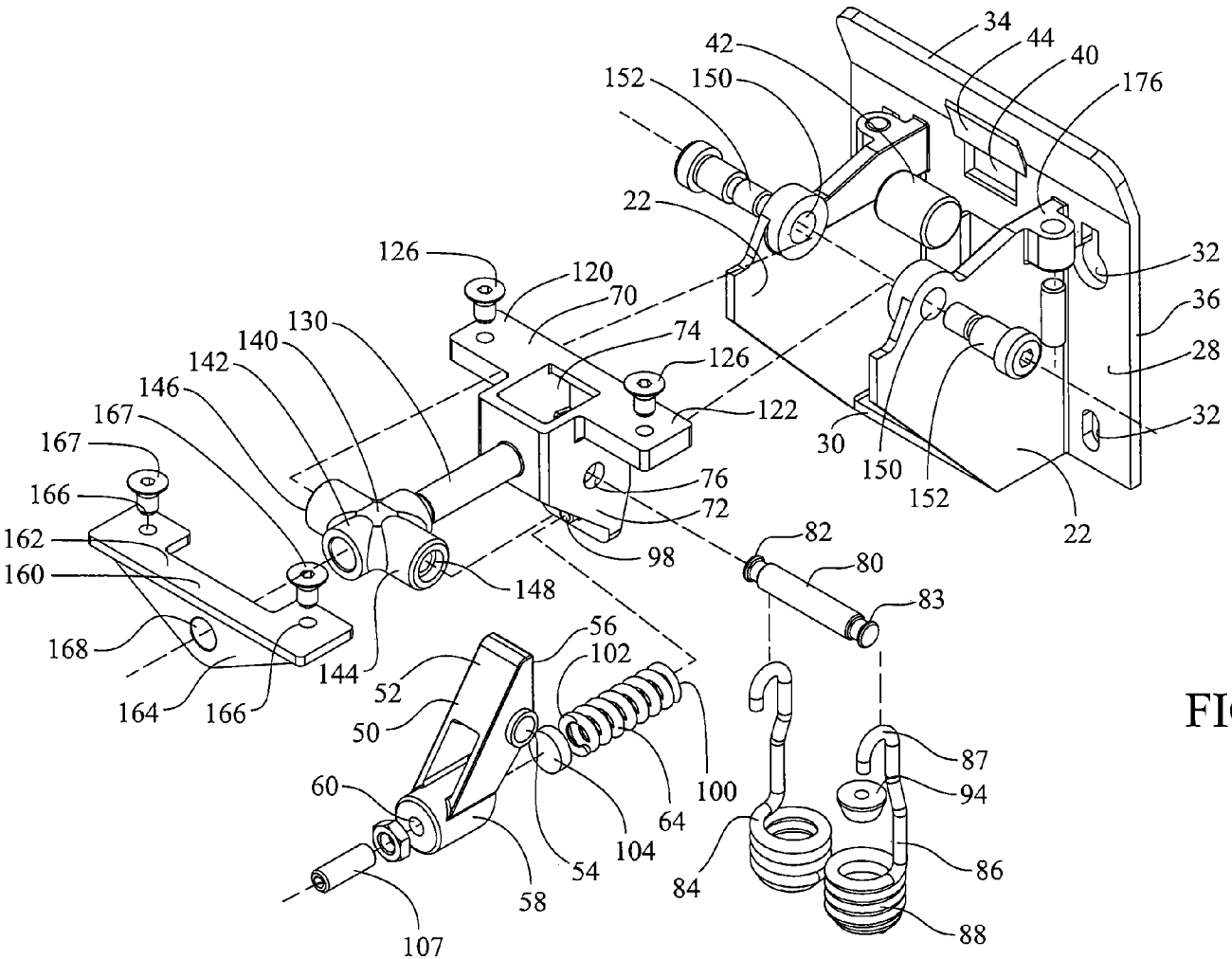
FIG. 2 is an exploded perspective view of a basketball rim mounting assembly.
Figure 3:
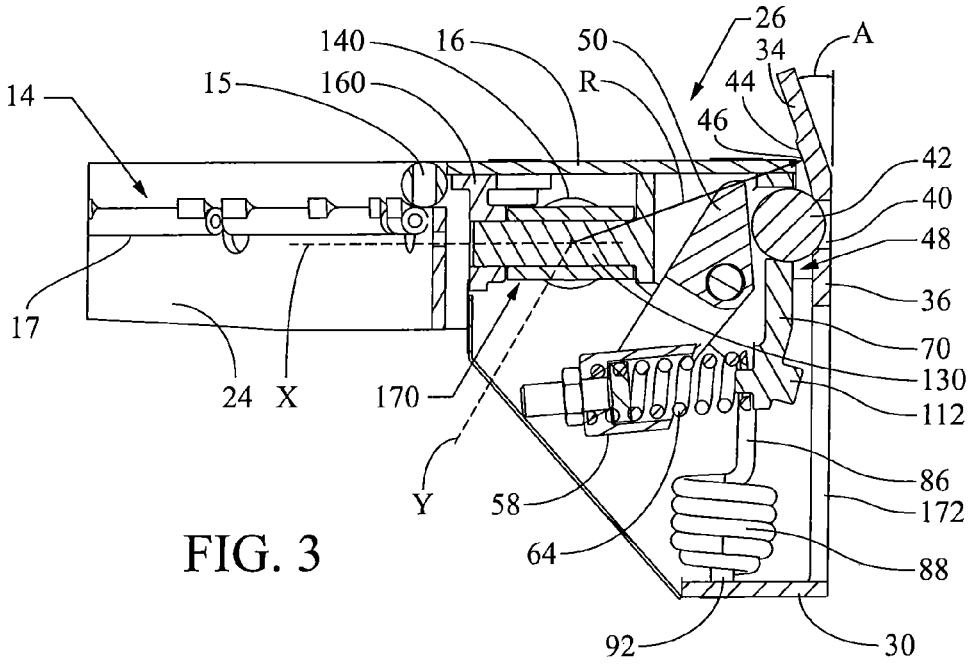
FIG. 3 is a transverse sectional partial view of the basketball rim mounting assembly in a rest position.

FIGS. 2-3 show that the bracket plates 22 can be fixed to each other by a back plate 28 and a base plate 30. The back plate 28 can be fixed to the backboard 12 by suitable fasteners, not shown, that extend through openings 32 formed in the back plate 28. The back plate 28 can have a forward extending portion 34 along the top portion thereof that extends away from a general planar portion 36 to which the bracket plates 22 can be fixed. The forward extending portion 34 can be angled away from the planar portion 36 by an angle A in the range of about 10-30 degrees, and preferably about 20 degrees. An opening detent 40 can be formed in the back plate 28. For example, the detent 40 can be formed approximately in the lateral middle of the back plate 28 just below the forward extending portion 34. The opening detent 40 can be configured to receive and retain at least a portion of a rollable member 42. The opening detent 40 may have a periphery that is sized and shaped similarly to the cross-section of the rollable member. In one example, the opening detent can include two opposite vertical sides that are contactable with planar ends of a cylindrical roller to facilitate retention the corresponding portion of the rollable member within the detent. The opening detent may include two opposite horizontal sides that are contactable with the rollable member. The opening detent window may be rectangular.

The rollable member 42 can be any shape that facilitates rolling and/or sliding. In one example, the rollable member 42 is a cylindrical rod having a cylindrical surface and two ends. In other examples, the rollable member may be spherical, polygonal, elliptical, or the like. An upper protrusion 44 can be provided along the front surface of the forward extending portion 34 of the back plate 28 and above, preferably directly above, the opening detent 40. The upper protrusion 44 can provide a rolling surface for the rollable member 42 when the rollable member is urged away from a rest position when the rollable member 42 is positioned within the opening detent 40. The upper protrusion 44 may be formed integrally with the back plate 28 or may be a separate piece that is attached to the back plate 28 by well known means in the art. The upper protrusion 44 is shown to be generally rectangular, and may extend laterally beyond the lateral margins of the opening detent 40.

In FIG. 3, the front surface 46 of the upper protrusion 44 may be further modified to be arcuate from top to bottom by a radius R. The center point of radius R may align with a tilt axis Y of pivot. A lower protrusion 48 may be provided along the front surface of the planar portion 36 of the back plate 28 and below, preferably directly below, the opening detent 40. The lower protrusion 48 may provide a physical barrier that can urge the rollable member 42 to return to its rest position within the opening detent 40 when the rollable member is moving downward. Surfaces forming the opening detent and around the opening detent, such as the upper and lower protrusions, may be hardened by well known means.

Figure 4:
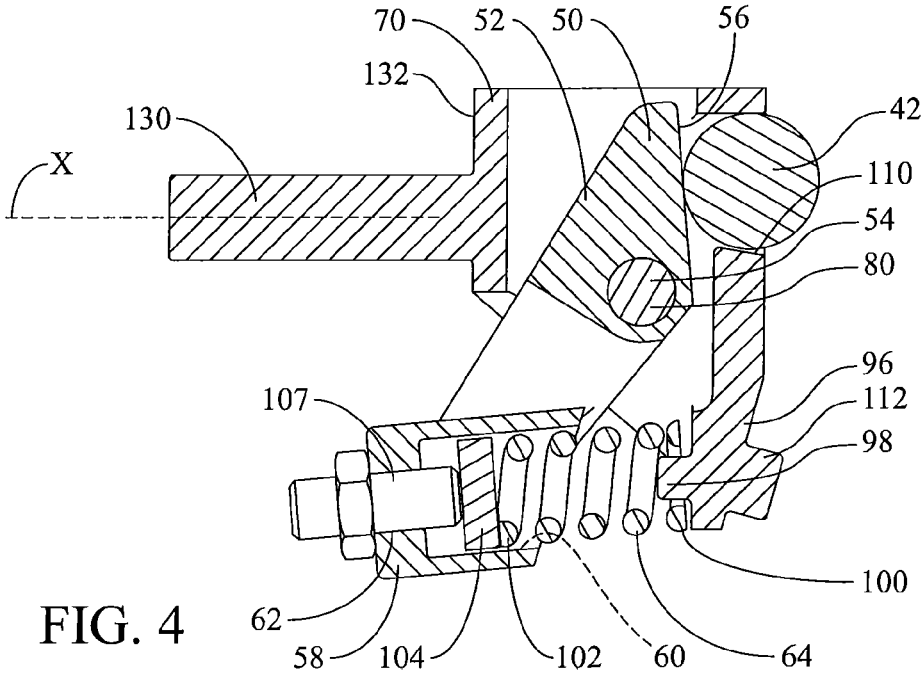
FIG. 4 is a vertical sectional view of a retaining member situated within a rear pivot block.

In FIGS. 2 and 4, a retaining member 50 can be inserted within a rear pivot block 70. The retaining member 50 can be situated to apply a biasing force to the rollable member 42. The retaining member 50 can include a center body 52 having a lateral opening 54 extending laterally through the center body 52. The center body 52 can include a rearward facing contact surface 56 at an upper end for contacting the rollable member 42. The contact surface 56 may be generally parallel with the front surface of the back plate 28. At an lower end of the center body 52 can be a tubular body 58 with a bore 60 extending therethrough. The tubular body 58 may extend generally horizontal, orthogonal to the contact surface 56. A front portion 62 of the bore 60 may be configured to receive an adjustment mechanism as will be explained. The retaining member 50 can be coupled to the rear pivot block 70 with a biasing member 64.

Figure 5:
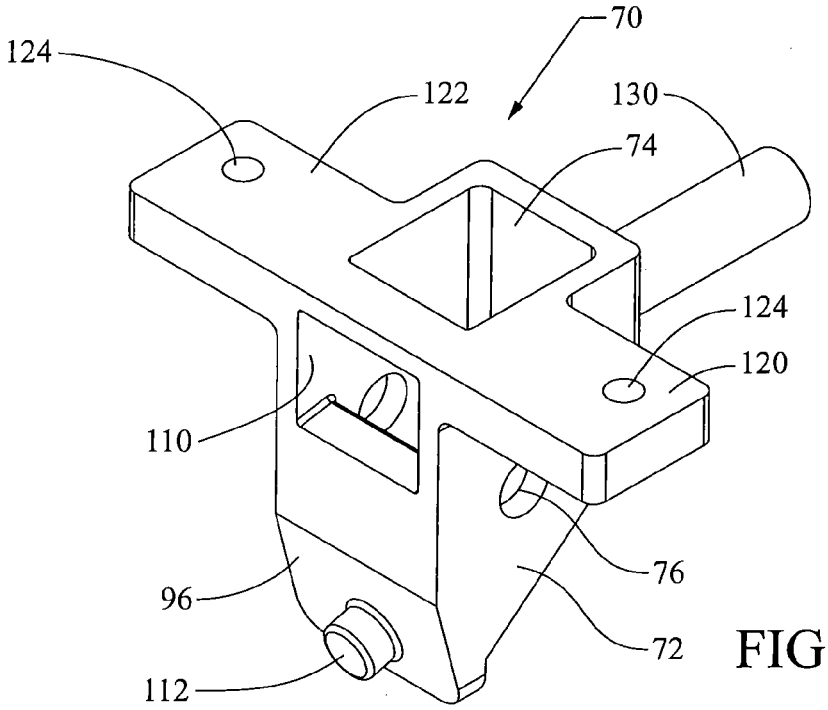
FIG. 5 is a rear perspective view of a rear pivot block.

In FIGS. 2 and 5, the rear pivot block 70 can have a rectangular tubular body 72 with a cavity 74 extending vertically therethrough for receiving at least a portion of the retaining member 50. The rear pivot block 70 can include a pair of side openings 76 formed through the sidewalls of the rear pivot block 70. The side openings 76 can be in alignment with the lateral opening 54 of the retaining member 50. The openings 54 and 76 can receive a coupling shaft 80 for coupling the rear pivot block with the retaining member.

Figure 8A:
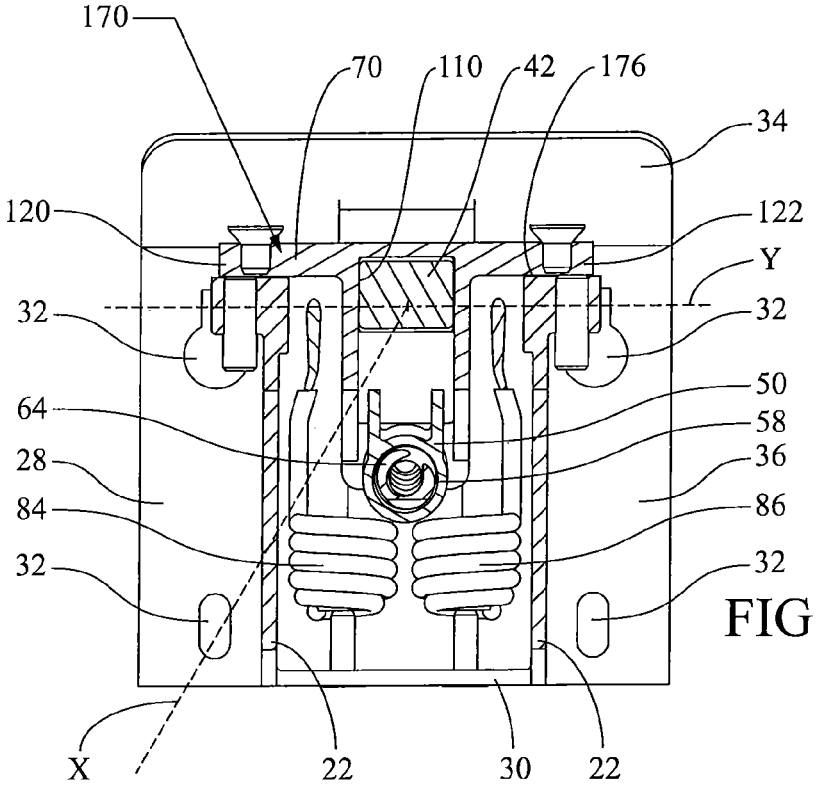
FIGS. 8A-8B are cross-sectional views taken along different lines 8A-8A and 8B-8B in FIG. 7, respectively.

The coupling shaft 80 can be sized to have lateral extending segments 82, 83 that extend beyond the side walls of the rear pivot block 70, but less than the width between the bracket plates 22. The coupling shaft 80 can be coupled to tension members 84, 86, such as tension springs, configured to bias the coupling shaft in a predefined orientation. For example, each of the lateral extending segments 82, 83 can have a reduced diameter portion to capture a hook end 87 of respective left and right tension members 84, 86. The left and right tension members are preferably spaced equidistant from a plane defined by a roll axis X of pivot, as shown in FIG. 8A. As shown in FIG. 3, a lower end 88, opposite the hook end 87, such as a spring coil portion, of the tension members 84, 86 can be coupled to the base plate 30. The lower end 88 can be coupled to the base plate 30 so that the tensions members 84, 86 are vertically oriented. In one example, the base plate 30 includes an opening 90 for receiving and mounting a guiding rod 92, such as a threaded screw, that extends upright from the base plate. An upper end portion of the guiding rod can be inserted through an aperture defined by the lower end of the tension member. It is contemplated that the tension members can be situated as compression members as appreciated by those skilled in the art.

The aperture of the lower end 88 of the tension member can receive a retainer 94, shown in FIG. 2, which can be coupled to the upper end portion of the guiding rod. The retainer 94 provides a physical stop to limit the vertical travel of the lower end 88 of the tension member along the guiding rod 92. The retainer 94 can have a portion sized larger than the coil aperture which tapers to a size to fit within the aperture of the tension member. In this instance, the tension caused by the tension members 84, 86 can be adjusted by the relative position between the retainer 94 and the lower end 88 of the tension member. When the retainer 94 is moved away from the base plate 30, the lower end 88 of the tension member can move vertically with the pivot assembly as shown by arrow 87 in FIG. 6. During vertical movement, the tension members can offer minimal resistance to the pivoting rear pivot block about the tilt axis Y until the lower end 88 of tension member 86 contacts the retainer 94 which is in a fixed position relative to the tension member. At which point, the tension member can offer a biasing force to resist further pivoting. On the other hand, when the retainer 94 is moved closer toward the base plate 30, there is less vertical movement of the tension member, and the tension member will offer earlier resistance to pivot. To this end, the minimum downward force load required to displace the rim from the horizontal position can be adjusted to a predetermined pre-load with adjustment of the retainer location within the tension members.

According to FIGS. 4-5, the rear pivot block 70 can include a lower wall having a lower end 96 that can include a nub 98 on the inside surface facing the forward direction. The biasing member 64, such as a spring or other types of devices known in the art, can be coupled between the lower rear wall 96 of the rear pivot block 70 and the bore 60 of the retaining member 50. The tension force of the biasing member 64 can cause the retaining member 70 to pivot about an axis defined by the coupling shaft 80 relative to the rear pivot block so that the contact surface 56 applies a biasing force against the rollable member 42. For example, the nub 98 is sized to receive a first end 100 of the biasing member 64 and the bore 60 is sized to receive a second end 102 of the biasing member 64. A tension adjustment mechanism can be included. For example, a disc member 104 can be inserted between the front end 102 of the biasing member 64 and an end wall 106 of the bore 60. The disc member 104 can be moved within the bore 60 by an adjustment rod 107, such as a threaded fastener, coupled through the front portion 62 of the bore 60 so that the tension force of the biasing member 64 can be adjusted. The tension force in the biasing member 64 can be adjusted by relative axial movement of the rod 107 by relative axial movement thereof, e.g., by rotation, in order to adjust the resistance caused by the biasing member to retain the rollable member 42 within the detent 40. To this end, the minimum downward force load required to displace the rim from the horizontal position can be adjusted to a predetermined pre-load with adjustment of the biasing member 64.

Figure 6:
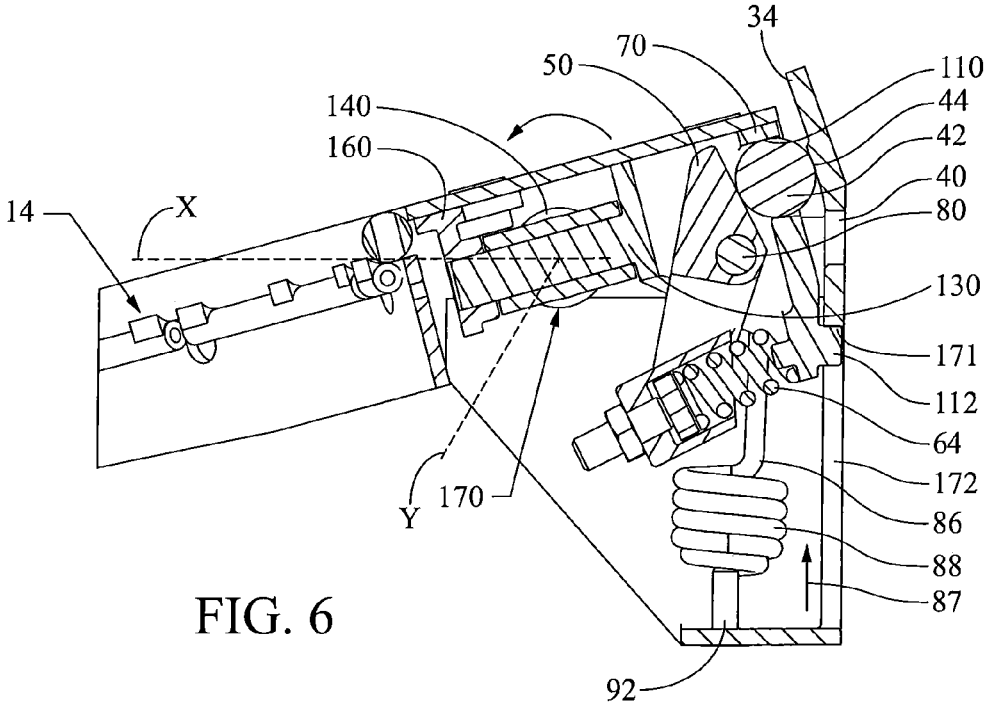
FIG. 6 is a transverse sectional partial view with the basketball rim mounting assembly being deflected downward away from a rest position.

The upper portion of the rear wall 96 of the rear pivot block 70 can include a guiding window 110. The guiding window 110 can be sized to receive the rollable member 42. The guiding window 110 can be recessed portion or can be in communication with the cavity 74 of the rear pivot block 70. The rollable member 42 can be captured between the guiding window 110 and the opening detent 40. The retaining member 52 can apply the biasing force against the rollable member 42 from the cavity 74 of the rear pivot block 70 and through the guiding window 110. The guiding window 110 can be configured to move the rollable member 42, by sliding and/or rolling, along the back plate 28, and in particular the surface 46 along the upper protrusion 44, in response to a downward force at the rim 14. A rear protrusion 112 may project from the rear facing surface of the lower rear wall 96. The rear protrusion 112 can be configured to limit the degree of pivoting of the rear pivot block 70 about the tilt axis Y of pivot, as shown in FIGS. 6 and 10C. The guiding window 110 may have a periphery that is sized and shaped similarly to the cross-section of the rollable member. In one example, the guiding window 110 can include two opposite vertical sides that are contactable with planar ends of the rollable member 42 for skewing or rotating the rollable member. The guiding plate may include two opposite horizontal sides that are contactable with the rollable member 42 for moving vertically the rollable member. The guiding window may be a rectangular window. As can be appreciated by those skilled in the art, the shape and size of the guiding window and the opening detent can depend on the cross-section of the rollable member. For example, for a spherical roller the window and detent may have a circular shape, and for a cylindrical roller the window and detent may have a rectangular shape.

In FIGS. 2-5, a left wing 120 and a right wing 122 may extend laterally from the upper portion of the side walls of the rear pivot block 70 for coupling to the top plate 16. For instance, the left and right wings 120, 122 can include wing openings 124 to be in alignment with a pair of rear openings extending vertically through the top plate 16 for receiving a fastener 126 therethrough. The wing openings 124 can be threaded for threadably attaching to the fastener.

In FIGS. 2-4, a pivot shaft 130 can extend outward from the front surface of the front wall 132 of the rear pivot block 70. The pivot shaft 130 may be formed integrally with the rear pivot block or can be a discrete member that is fixedly attached to the rear pivot block. The pivot shaft 130 defines the roll axis X of pivot of the rim assembly. The rear pivot block 70 can be coupled to a center pivot block 140. The center pivot block 140 can have a longitudinal tubular body 142 that intersects a lateral tubular body 144. The longitudinal tubular body 142 can have a lumen sized to receive the pivot shaft 130 in a friction fit manner, however, the center pivot block 140 may be still capable of pivoting or rotating about the pivot shaft 130. The lateral tubular body 144 has a left end opening 146 and a right end opening 148. The left and right end openings 146, 148 can be in alignment with side openings 150 formed in the bracket plates 22 for receiving a fastener 152. When the center pivot block 140 is coupled to the bracket plates 22, the lateral tubular body 144 defines the tilt axis Y of pivot of the rim assembly. The side openings 150 can be threaded in order to be threadably attached with the fastener 152.

In FIGS. 2-3, a front pivot block 160 can be coupled to the pivot shaft 130, with the center pivot block which can be disposed between the front and rear pivot blocks. The front pivot block 160 can include a horizontal top portion 162 and a vertical lower portion 164 depending from the top portion 162. The top portion can include openings 166 to be in alignment with a pair of front openings extending vertically through the top plate 16 for receiving a fastener 167 therethrough. The top portion openings 166 can be threaded for threadable attachment with the fastener 167. As a result, the top plate 16 can be directly coupled to the rear pivot block 70 and the front pivot block 160. The vertical portion 164 can include a horizontal opening 168 for receiving the pivot shaft 130 in order to couple to the pivot shaft. The center pivot block 140 can be positioned between the front and rear pivot blocks 160 and 70 to form a pivot axis member or assembly 170 shown in FIG. 3.

FIG. 3 depicts the components of FIG. 2 assembled to form the movable portion 26 of the rim 14. The retaining member 50 biases the rolling member 42 found in the window guide 110 within the opening detent 40 of the back plate 28 in a rest position when the rim 14 is in a horizontal position. The window guide 110 can be in alignment with the opening detent 40 so that the rollable member 42 is captured therebetween.

Any change in position of the rim, which might occur as a result of a downward force on the rim, such as from a dunk shot or a player hanging on the rim, causes a corresponding change in position of the rim and the movable portion. FIG. 6 depicts an instance where a downward force being applied approximately at the front of the rim 14 to move the rim to a displaced position away from the horizontal position. The pivot assembly 170 can pivot about the tilt axis Y, whereby the front pivot block 160 is moved downward relative to a horizontal plane formed by the roll axis X and the tilt axis Y, and the rear pivot block 70 can be moved upward relative to the horizontal plane. As a result of the repositioning of the rear pivot block 70, sides of the guiding window 110 can move the rollable member 42 upward along the front surface of the upper protrusion 44, with the retaining member 50 applying the biasing force to the rollable member 42 against the front surface. The degree of angularity of the forward extending portion 34 and/or curvature of the front surface 46 can permit an increasingly larger resistance to the breakaway of the rim due to the rollable member being displaced farther in the forward direction.

In response, the retaining member 50 can reactively tend to pivot about the coupling shaft 80 so that the biasing member is farther compressed between the retaining member and the rear pivot block, which can increase the resistance. The retaining member 50 can also independently pivot relative to the rear pivot block 70 about the axis defined by the coupling shaft 80, which may cause the portion of the biasing member 64 external to the tubular portion 58 to bow relative to the nub 98. Further, the rear pivot block 70 and the retaining member 50 may move the lower end 88 of the tension members 84, 86 in an upward direction, represented by arrow 87, and may further extend the tension members to increase the resistance caused thereby. As shown in FIG. 6, the inner edge 171 of a slot 172 formed in the back plate 28 can be a physical stop to limit the travel of the rear protrusion 112. The rear protrusion 112 can be laterally sized to fit within slot the 172. The depth of rearward protrusion can be such that the end of the rear protrusion does not extend past the rear surface of the back plate.

Upon release of the rim 14 from its displaced position, the biasing force provided by the tension members 84, 86 and/or the biasing member 64 can cause the guiding window 110 of the rear pivot block to realign with the opening detent 40 of the base plate so that the rollable member 42 can be recaptured therebetween. The pivot assembly 170 can then pivot about the tilt axis Y so that the front pivot block 160 and the rear pivot block are substantially parallel to the horizontal plane formed by the axis X and axis Y. To this end, the pivot assembly 170 is returned to its original rest position and the rim is returned to its horizontal position. This return of the pivot assembly 170 to its rest position assures that the top plate 16 also returns to its original position.

Figure 7:
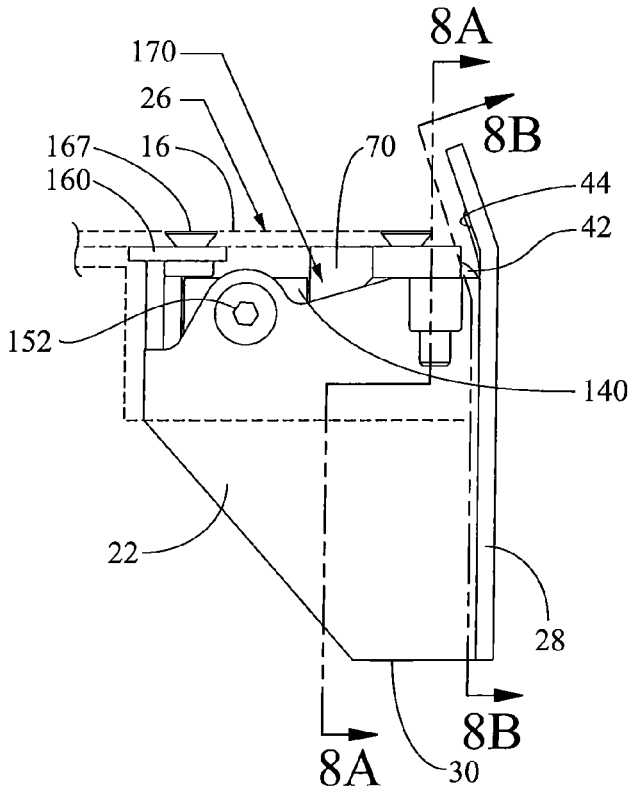
FIG. 7 is a side view of the basketball rim mounting assembly in a rest position.
Figure 9:
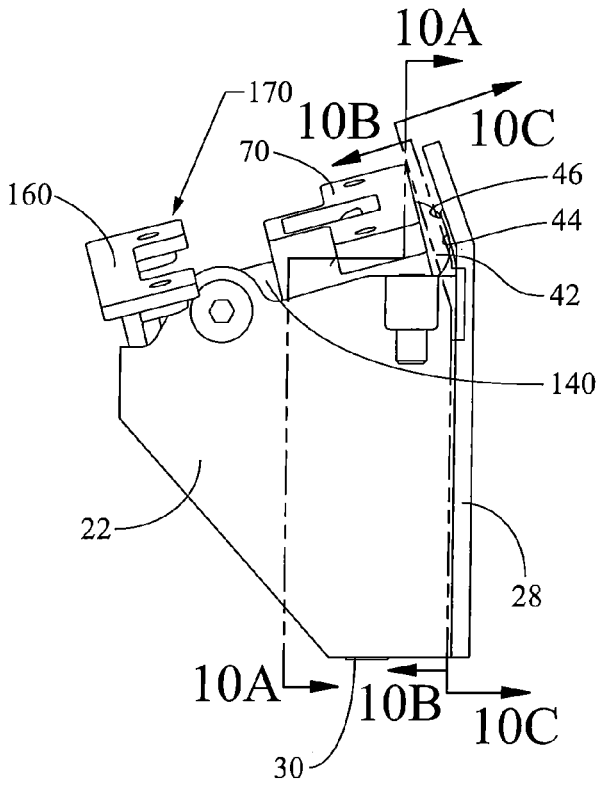
FIG. 9 is a side view of the basketball rim mounting assembly being deflected toward the side away from the rest position.

FIGS. 7-10C depict movement of the rim from a horizontal rest position to a displaced position skewed away from the horizontal rest position by application of a force to a side of the rim. FIG. 7 depicts a partial side view of the rim assembly, with the movable portion shown in phantom lines. The pivot assembly 170 is in the original rest position and the rim is in the horizontal position. On the other hand, FIG. 9 depicts a partial side view of the rim assembly shown in FIG. 7, with the pivot assembly 170 moved away from the original rest position and the rim in the displaced position.

Figure 8B:
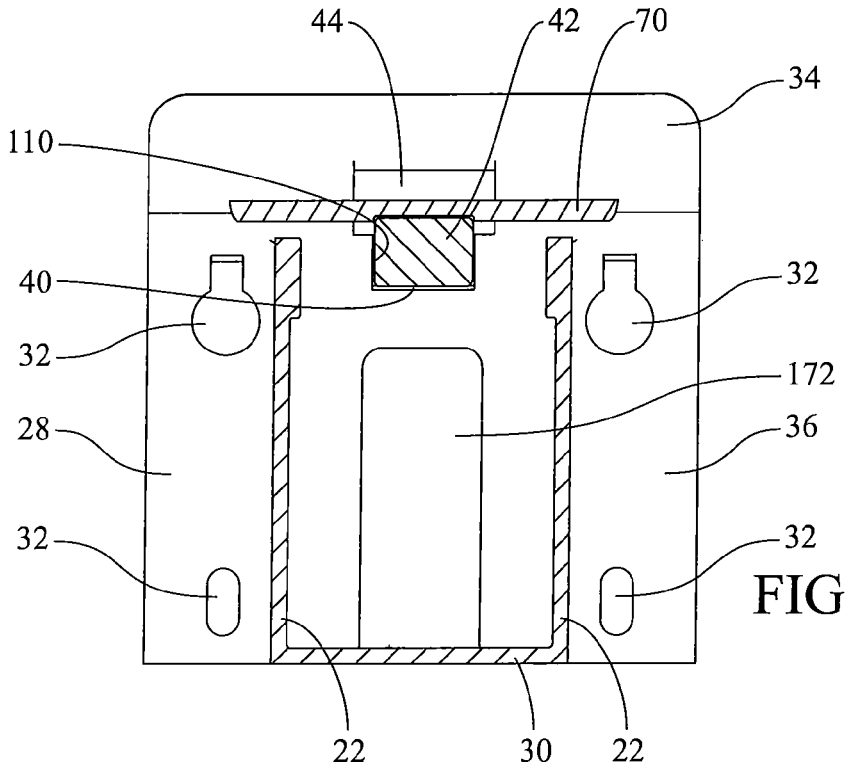

FIGS. 8A and 8B are cross-sectional views taken along different lines 8A-8A and 8B-8B in FIG. 7, respectively, depicting the relative position of the components at the rest position. The rollable member 42 can be captured between the guiding window 110 and the opening detent 40. FIG. 8A depicts that the lower surface of the wings 120, 122 of the rear pivot block 70 can engage the top edge 176 of the bracket plates 22. In FIG. 8B, the rollable member 42 when cylindrical is in a generally horizontal position. The biasing members 84, 86 in this configuration may be biasing the pivot assembly 170 in the rest position.

Figure 10A:
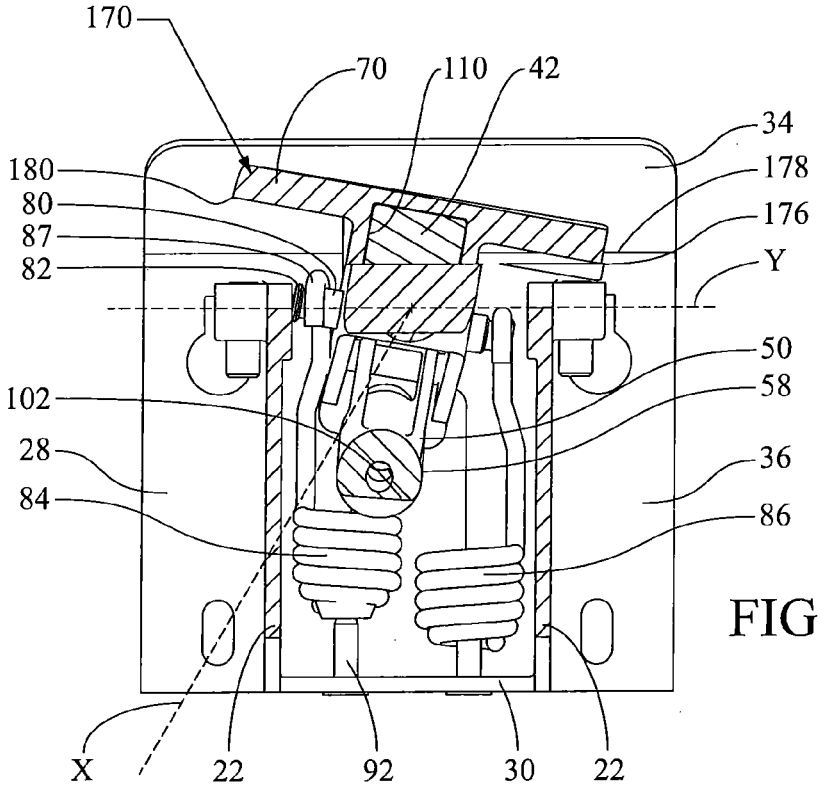
FIGS. 10A-10C are cross-sectional views taken along different lines 10A-10A, 10B-10B, and 10C-10C in FIG. 9, respectively.
Figure 10C:
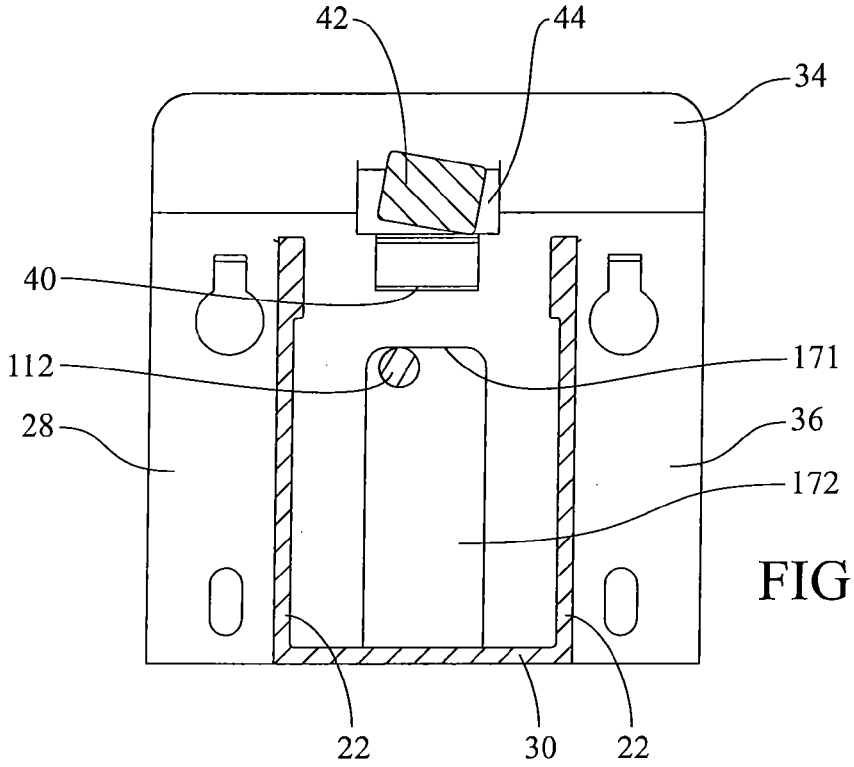
Figure 10B:
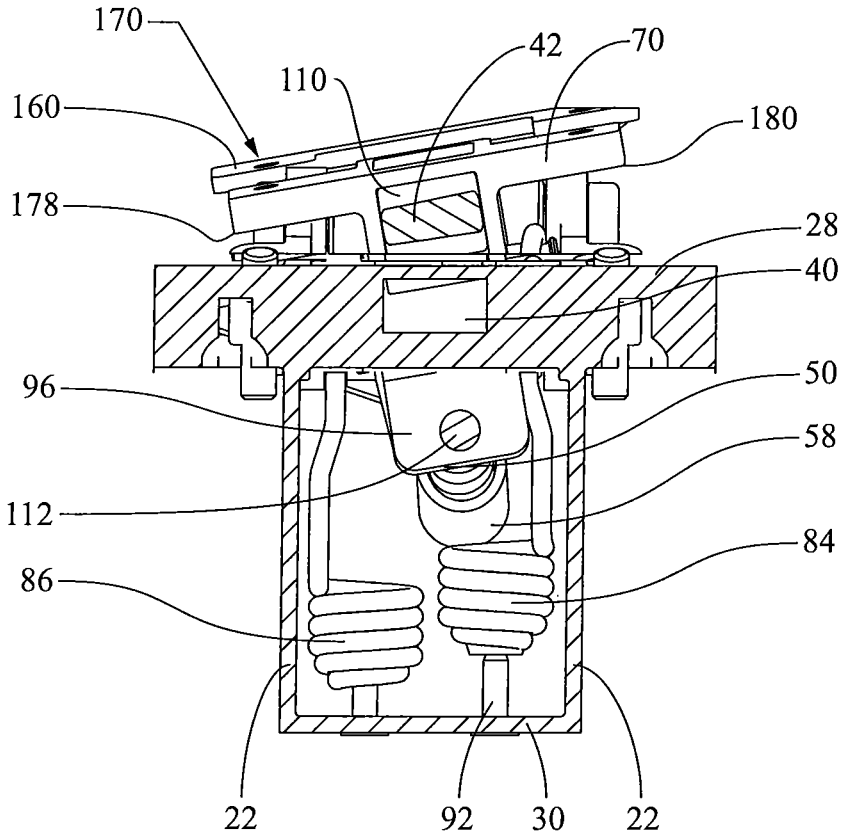

FIGS. 10A-10C are cross-sectional views taken along different lines 10A-10A, 10B-10B, and 10C-10C in FIG. 9, respectively, depicting the relative position of the components after movement. In FIG. 10A, the pivot assembly 170 can roll about the roll axis X, whereby a first lateral end 178 of the pivot assembly can remain engage with the top edge 176 of one of the bracket plates, while the opposite second lateral end 180 of the pivot assembly is moved vertically away from the top edge of the other of the bracket plates. As a result of the repositioning of the rear pivot block 70, sides of the guiding window 110 can move the rollable member 42 away from the opening detent 40. For example, the guiding window can move the rollable member to a skewed position against the front surface 46 of the upper protrusion 44, as shown in FIG. 10C. The retaining member 50 can apply a biasing force to the rollable member 42 in the skewed position against the front surface 46. The rollable member in the skewed position may pivot in the direction of the rear pivot block. It can be appreciated by those skilled in the art that the rollable member may pivot slightly while having a portion proximate the detent. Further, the movement of the second lateral end 180 can extend one of the tension members, e.g., tension member 84, and/or can compress the biasing member 64, as shown for example in FIG. 6. The lower tubular body 58 of the retaining member 50 is moved laterally away from the plane defined by the roll axis X.

Upon release of the rim 14 from its displaced skewed position, the biasing force provided by the tension member 84 and/or the biasing member 64 causes a realignment of the guiding window 110 of the rear pivot block and the opening detent 40 to recapture the rollable member 42 therebetween. To this end, the pivot assembly 170 is returned to its original rest position and the rim is returned to its horizontal position. This return of the pivot assembly 170 to the rest position assures that the top plate 16 also returns to its original position.

The pair of tension members 84, 86 can be located on opposite sides of the plane defined by the roll axis X so that the adjustment of the force applied by the tension members can be used to govern the roll rest position of the top plate 16 and rim 14, thus achieving the desired horizontal planar location of the roll axis X and the tilt axis Y. By suitable selection of tension members having substantially identical modulus and the biasing member, the force necessary to cause the rim 14 to break-away from its normal horizontal position can be selected so that the force is the same in any direction regardless of where on the rim 14 the force might be applied. Upon release of the rim 14 from its displaced position, the biasing force provided by the tension members and/or the biasing member can cause a realignment of the top plate 16 relative to the base plate 30 as well as a net change in position of the pivot assembly 170. It can be appreciated that a downward force along suitable portions of the rim can cause a combination of a vertical movement of the rollable member and pivot of the pivot assembly about the tilt axis Y, as shown in FIG. 6, and a skewing of the rollable member and pivot of the pivot assembly about the roll axis X, as shown in FIGS. 9-10C.

While these features have been disclosed in connection with the illustrated preferred embodiment, other embodiments of the invention will be apparent to those skilled in the art that come within the spirit of the invention as defined in the following claims.

What is claimed is:

1. A basketball rim mounting assembly comprising:

a fixed portion adapted to be coupled to a backboard and a movable portion fixed to a basketball rim, the fixed portion including a back plate adapted to be secured to the backboard, the back plate having an opening detent formed therein, the movable portion including a tilt regulating structure coupled between the fixed portion and the movable portion, the tilt regulating structure comprising a retaining member, a first wall with a window formed therein, and a rollable member, the rollable member movable between a rest position when the basketball rim is in a horizontal position and a displaced position away from the rest position when the basketball rim is in a non-horizontal position, wherein, in the rest position, at least a portion of the rollable member is captured between the opening detent and the window, and the retaining member is configured to bias the rollable member in the rest position, and wherein deflection of the basketball rim to the non-horizontal position causes the window of the tilt regulating structure to displace the rollable member to the displaced position.

2. The basketball rim mounting assembly of claim 1, further comprising a first pivot block, the first pivot block including a cavity to house at least a portion of the retaining member.

3. The basketball rim mounting assembly of claim 2, wherein the first pivot block and the retaining member are coupled to one another.

4. The basketball rim mounting assembly of claim 3, further comprising one or more tension members coupled between the fixed portion and at least one of the retaining member and the first pivot block.

5. The basketball rim mounting assembly of claim 1, wherein the rollable member is a cylindrical rod.

6. The basketball rim mounting assembly of claim 1, wherein the back plate comprises a forward angled portion to limit the amount of displacement of the rollable member.

7. A basketball rim mounting assembly comprising:

a fixed portion adapted to be coupled to a backboard and a movable portion fixed to a basketball rim, the fixed portion including a back plate adapted to be secured to the backboard, and a pair of vertical bracket plates fixed to and extending forward from the back plate, the movable portion including a to plate extending at least between the bracket plates, a pivot axis member coupled between the fixed portion and the movable portion and defining a tilt axis of pivot and a roll axis of pivot for the movable portion, and a tilt regulating structure coupled to the pivot axis member, wherein the tilt regulating structure comprises a retaining member and a rollable member positioned between the retaining member and the back plate, the retaining member is configured to bias the rollable member against the back plate in a rest position when the basketball rim is in a horizontal position, and deflection of the basketball rim to a non-horizontal position causes the pivot axis member to pivot about at least one of the tilt axis and the roll axis so that the rollable member is displaced away from the rest position along the back plate, wherein the pivot axis member comprises a pivot block, the pivot block having walls interconnected to one another to define a cavity, one of the walls having a window formed therein being configured to retain at least a portion of the rollable member.

8. The basketball rim mounting assembly of claim 7, further comprising a coupling shaft, wherein the retaining member includes a first lateral bore extending therethrough, and the pivot block includes a second lateral bore extending between the walls, and aligned with the first lateral bore, wherein the coupling shaft is situated within the first and second lateral bores.

9. The basketball rim mounting assembly of claim 8, further comprising a horizontal plate fixed between the bracket plates, and one or more tension members coupled between the horizontal plate and the coupling shaft.

10. The basketball rim mounting assembly of claim 7, wherein the retaining member is situated within the cavity of the pivot block, and is configured to contact the rollable member through the window.

11. The basketball rim mounting assembly of claim 7, further comprising a biasing member coupled between the retaining member and the pivot block.

12. A basketball rim mounting assembly comprising:

a fixed portion adapted to be coupled to a backboard and a movable portion fixed to a basketball rim, the fixed portion including a back plate adapted to be secured to a front face of the backboard, the back plate having an opening detent formed therein, and a pair of vertical bracket plates fixed to and extending forward from the back plate, the movable portion including a top plate extending at least between the bracket plates, a tilt regulating structure coupled between the fixed portion and the movable portion, and a first pivot block defining a cavity and including a guiding window, the tilt regulating structure comprising a retaining member situated within the cavity of the first pivot block, a cylindrical roller, and a biasing member, the biasing member coupled between the retaining member and the first pivot block, the retaining member capable of biasing the roller through the guiding window, the roller having a first position when the roller is disposed between the guiding window and the opening detent and when the basketball rim is in a horizontal position, wherein deflection of the basketball rim to a non-horizontal position causes one or more sides of the guiding window to displace the roller away from the first position.

13. The basketball rim mounting assembly of claim 12, wherein the first pivot block and the retaining member are coupled to one another, and one or more tension members are coupled between the fixed portion and at least one of the retaining member and the first pivot block.

14. The basketball rim mounting assembly of claim 12, further comprising a second pivot block, the second pivot block having a lateral portion coupled between the bracket plates to define a tilt axis of pivot for the tilt regulating structure, and a longitudinal portion coupled to the first pivot block to define a roll axis of pivot for the tilt regulating structure.

15. The basketball rim mounting assembly of claim 12, wherein the back plate comprises a forward angled portion directly above the opening detent.

16. A basketball rim mounting assembly comprising:

a fixed portion adapted to be coupled to a backboard and a movable portion fixed to a basketball rim, the fixed portion including a back plate adapted to be secured to the backboard, and a pair of vertical bracket plates fixed to and extending forward from the back plate, the movable portion including a top plate extending at least between the bracket plates, a pivot axis member coupled between the fixed portion and the movable portion, the pivot axis member defining a tilt axis of pivot and a roll axis of pivot for the movable portion, and a single mechanism to inhibit any movement of the basketball rim in relation to both the tilt axis and the roll axis until a minimum force is applied to the basketball rim, the single mechanism comprising a tilt regulating structure coupled to the pivot axis member, the tilt regulating structure including a retaining member and a rollable member positioned between the retaining member and the back plate, wherein the retaining member is configured to bias the rollable member against the back plate in a rest position when the basketball rim is in a horizontal position, and deflection of the basketball rim to a non-horizontal position causes the pivot axis member to pivot about at least one of the tilt axis and the roll axis so that the rollable member is displaced away from the rest position along the back plate.

17. The basketball rim mounting assembly of claim 16, wherein the back plate includes an opening detent formed therein, where in the rest position the rollable member is disposed and biased within the opening detent.

18. A basketball rim mounting assembly comprising:

a fixed portion adapted to be coupled to a backboard and a movable portion fixed to a basketball rim, the fixed portion including a back plate adapted to be secured to the backboard, the back plate having an opening detent formed therein, the movable portion including a tilt regulating structure coupled between the fixed portion and the movable portion, the tilt regulating structure comprising a retaining member, a first wall with a window formed therein, a rollable member that is movable between a rest position when the basketball rim is in a horizontal position and a displaced position away from the rest position when the basketball rim is in a non-horizontal position, a first pivot block including a cavity to house at least a portion of the retaining member, and a second pivot block, the second pivot block having a lateral portion coupled to the fixed portion to define a tilt axis of pivot for the tilt regulating structure, and a longitudinal portion coupled to the first pivot block to define a roll axis of pivot for the tilt regulating structure, wherein, in the rest position, the rollable member is at least partially captured between the opening detent and the window, and the retaining member is configured to bias the rollable member in the rest position, and wherein deflection of the basketball rim to the non-horizontal position causes the window of the tilt regulating structure to displace the rollable member to the displaced position.

19. The basketball rim mounting assembly of claim 18, wherein the first pivot block includes a pivot shaft configured to be received within a lumen of the longitudinal portion of the second pivot block.

20. A basketball rim mounting assembly comprising:

a fixed portion adapted to be coupled to a backboard and a movable portion fixed to a basketball rim, the fixed portion including a back plate adapted to be secured to the backboard, the back plate having an opening detent formed therein, the movable portion including a tilt regulating structure coupled between the fixed portion and the movable portion, the tilt regulating structure comprising a retaining member, a first wall with a window formed therein, a rollable member that is movable between a rest position when the basketball rim is in a horizontal position and a displaced position away from the rest position when the basketball rim is in a non-horizontal position, a first pivot block including a cavity to house at least a portion of the retaining member, and a biasing member coupled between the retaining member and the first pivot block, wherein, in the rest position, the rollable member is at least partially captured between the opening detent and the window, and the retaining member is configured to bias the rollable member in the rest position, and wherein deflection of the basketball rim to the non-horizontal position causes the window of the tilt regulating structure to displace the rollable member to the displaced position.

* * * * *

UNITED STATES PATENT AND TRADEMARK OFFICE

CERTIFICATE OF CORRECTION

PATENT NO. : 8,454,460 B2
APPLICATION NO. : 13/070126
DATED : June 4, 2013
INVENTOR(S) : James J. Connerley It is certified that error appears in the above-identified patent and that said Letters Patent is hereby corrected as shown below:

In the Claims

Column 10, line 7, "to" should be replaced with -- top --

Signed and Sealed this
Twenty-seventh Day of August, 2013

Teresa Stanek Rea
*Acting Director of the United States Patent and Trademark Office*